US005179894A

United States Patent [19]

Hinz et al.

[11] Patent Number: 5,179,894

[45] Date of Patent: Jan. 19, 1993

[54] CALENDER WITH POSITIONABLE ROLLERS

[75] Inventors: Joachim Hinz, Tettnang; Josef Schneid, Vogt; Andreas Steidele, Ravensburg-Schmalegg; Karl Volz, Baindt; Wolf-Gunter Stotz, Ravensburg, all of Fed. Rep. of Germany

[73] Assignee: Sulzer Escher Wyss GmbH, Ravensburg, Fed. Rep. of Germany

[21] Appl. No.: 603,633

[22] Filed: Oct. 26, 1990

[30] Foreign Application Priority Data

Oct. 28, 1989 [DE] Fed. Rep. of Germany ..... 3936048

[51] Int. Cl.[5] ..... B30B 3/04

[52] U.S. Cl. ..... 100/163 A; 100/170; 100/171

[58] Field of Search ..... 100/47, 161, 162 R, 100/163 R, 163 A, 164, 165, 168-171

[56] References Cited

U.S. PATENT DOCUMENTS

| | | | |
|---|---|---|---|
| 3,369,483 | 2/1968 | Müller | 100/162 R X |
| 3,584,570 | 6/1971 | Sass et al. | 100/170 X |
| 4,380,954 | 4/1983 | Edele | 100/170 X |
| 4,510,859 | 4/1985 | Berry | 100/170 X |
| 4,736,678 | 4/1988 | Stotz | 100/163 A |
| 4,823,690 | 4/1989 | Stotz | 100/163 A |
| 4,890,551 | 1/1990 | Dal et al. | 100/163 A |
| 4,924,772 | 5/1990 | Schlunke et al. | 100/163 R |
| 4,967,653 | 11/1990 | Hinz | 100/163 A X |

FOREIGN PATENT DOCUMENTS

| | | | |
|---|---|---|---|
| 1054953 | 4/1959 | Fed. Rep. of Germany | 100/163 A |

*Primary Examiner*—Harvey C. Hornsby
*Assistant Examiner*—Stephen F. Gerrity
*Attorney, Agent, or Firm*—Townsend and Townsend

[57] ABSTRACT

In a calender (1) one or several rollers (2) can be positioned by being raised or lowered jointly with the roller stack disposed therebelow; and vertically displaceable sliding members (3) connected with the roller journals are jointly driven, and are blocked when the roller to be positioned (2) is adjacent the desired working position by way of a separate fixation device (6) supported on the frame (4). In a development of the method the rollers are brought in a desired working position after blocking of the fixation device.

20 Claims, 3 Drawing Sheets

CALENDER WITH POSITIONABLE ROLLERS

FIELD OF THE INVENTION

The invention relates to a method for the positioning of rollers on a calender having at least one intermediate roller between an uppermost and an lowermost roller, the intermediate roller having bearings which are supported in sliding members which are vertically movable with respect to a support for and can be fixed with respect to the support and thereby to determine essentially the position of the respective roller.

BACKGROUND OF THE INVENTION

The calenders known for a suitable use are usually so constructed that a plurality of rollers are arranged vertically above each other, the rollers being rotatably mounted about their axes. In this manner is defined a stack of rollers above one another such that working slots are defined between the successive rollers for the web to be calendered. During the operation of the calender the intermediate rollers have generally the possibility to adjust within a given range in the pressure direction, as they are in force transmitting contact over their roller surface with the adjacent rollers. Furthermore it is occasionally necessary to modify the spatial position of the rollers. This can be for instance the case when the mutual gaps between the rollers must be modified for operating reasons, for example to open the slot. It is further occasionally necessary to adjust the position of the rollers when rollers having a different diameter are to be installed. For these reasons a calender is so constructed that a displacement of at least a part of the rollers in the vertical direction is possible.

It is often advantageous to select a type which permits a coarse positioning and a fine positioning of the axes of the rollers. The reason therefor is that under certain conditions, which are always to be taken into account when operating a calender, a fast opening of the roller slot can be necessary. The high speed of the opening step is then absolutely essential, short opening displacements being in this case sufficient. The situation is different for the coarse positioning of the rollers, which either has to take into account the modified roller diameters or must achieve the necessary access between the rollers. In this adjustment step it is of first importance to ensure an adjustment range greater with respect to the first one, in order to be able to carry out this adjustment step simply and securely.

Solutions are known in which the parts which carry the bearings for the rollers are vertically slidably mounted on the frame of the calender. The adjustment and the fixation of these parts is ensured in these known solutions by means of quite expensive and complicated adjustment systems, which in addition are not clearly constructed and are therefore not easily operable. Furthermore they necessitate a great number of moving machine parts with all their drawbacks.

It is an object of the present invention to achieve a method with which the positioning of the calender rollers can be ensured in the simplest and most secure manner, and in order to simplify the calender the expense of additional necessary parts must be maintained as low as possible.

This object is totally met according to the invention in a method described at the beginning wherein the vertical adjustment of the guide members is effected in such a manner that a raising or lowering movement of the roller associated to the guide member is carried out jointly with the rollers disposed below this roller and in mutual contact at least in the vicinity of the position desired for the considered roller and wherein the sliding member is driven by the raising or lowering movement of the associated roller, and in the desired position the fixation of the sliding member to be adjusted in height is effected by means of a separate fixation device supported on the support.

Further advantageous developments of the method and devices for carrying out the method will appear in the ensuing description.

BRIEF DESCRIPTION OF THE DRAWINGS

The invention will be hereafter described with reference to the drawings, in which.

DESCRIPTION OF THE PREFERRED EMBODIMENT

Figure 1:
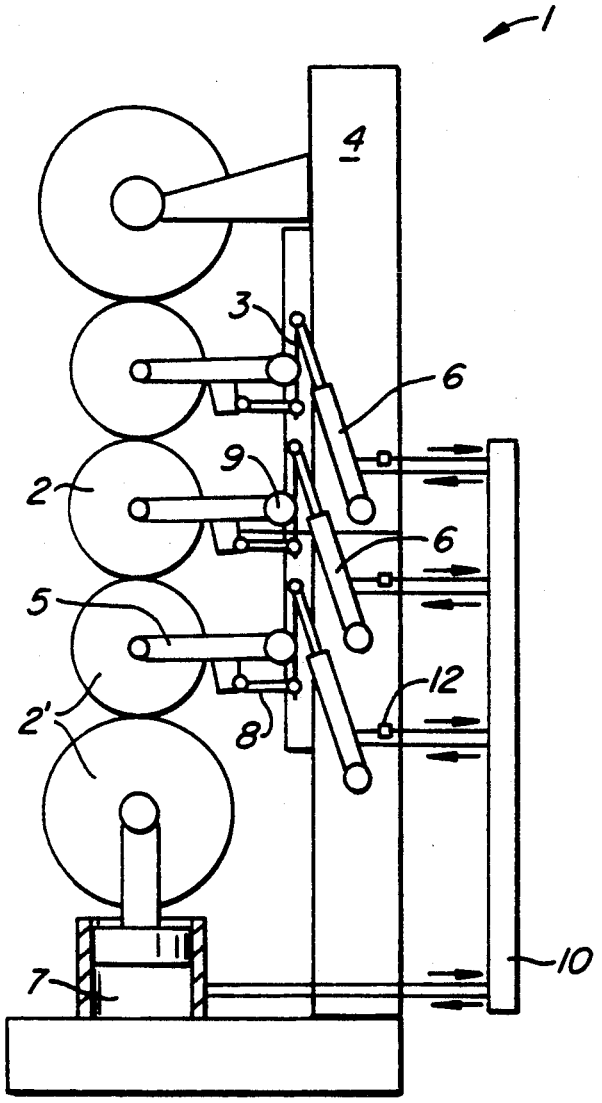
FIG. 1 is a schematic side view of a calender according to the invention before the beginning of the lowering displacement or after the end of the raising displacement.

FIG. 1 schematically illustrates those parts of a calender which are important for carrying out the method, notably the roller 2 to be positioned with the associated sliding member 3, which is supported on the calender frame or support 4 by means of a fixation device 6. In the illustrated embodiment the fixation devices 6 are formed as hydraulic piston and cylinder systems with two end fittings, which can be supplied with a pressurized fluid from a fluid supply 10 such as a pressurized oil supply. The fluid supply 10 can be provided with means 12 for blocking the displacement of the piston in cylinder units by the closure of pressurized fluid in inlets and/or outlets. Below the roller 2 to be adjusted are disposed in the present example three rollers 2'. The lowermost of these rollers 2' can be displaced in vertical direction by means of a device 7 which ensures the raising and lowering movement. The rollers which are guided on the support by the sliding members 3 are mounted on the sliding member 3 by means of levers 5 and journals 9. Other possibilities can however also be envisaged for carrying out the method. The device can, for example, be formed by adjustable supporting members of a deflection compensating roller.

In order to ensure a substantially uniform vertical displacement of the sliding members 3 associated to the rollers when the latter are displaced, there are provided blocking devices 8 which are intended to maintain a constant angle between the lever 5 and the sliding member 3 during the raising or the lowering displacement. These blocking devices are in this case in the form of hydraulic piston and cylinder systems with two end fittings which can be supplied by a pressurized fluid. Advantageously they can also be used during operation of the calender for the compensation of overhanging loads or so-called nip relieving.

Figure 2:
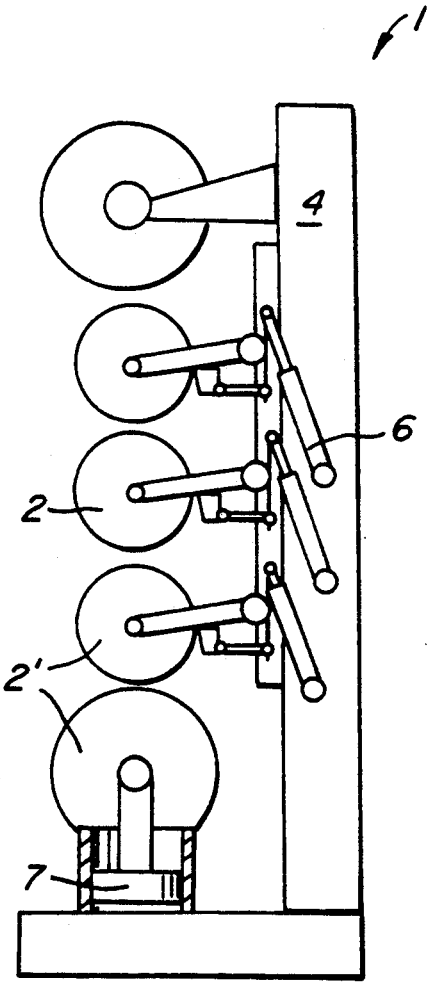
FIG. 2 is a side view similar to that of FIG. 1 after the lowering displacement.
Figure 3:
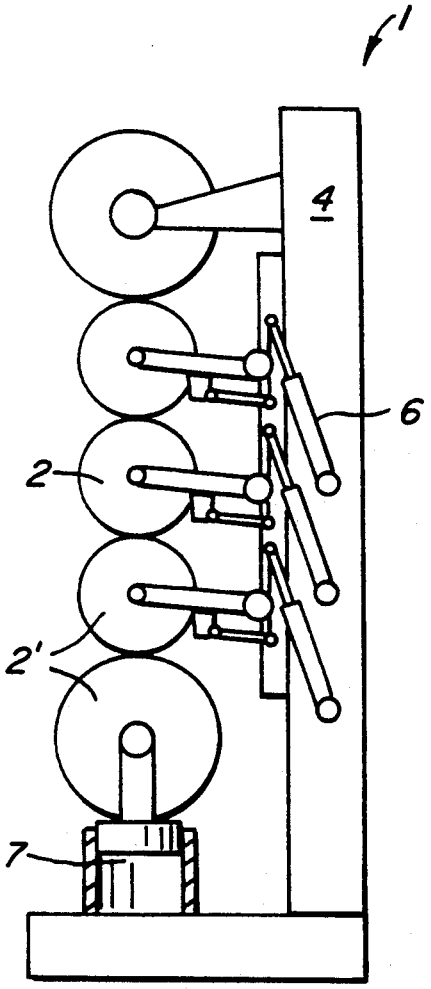
FIG. 3 is a side view similar to that of FIG. 1 after the raising displacement.

FIG. 1 shows the operating condition, thus the situation before the opening of the calender, whereas according to FIG. 2 the opening is already achieved. In FIG. 2 the roller 2 can be accessed from above and from below, the supporting device 8 resting on one of the end abutments. In the event that the rollers must be again set in their desired position, a raising displacement is effected by means of the device 7, whereby the rollers come again in mutual contact and the supporting device 8 comes into engagement with the other end abutment. Each of the fixation devices 6 is again unlocked at the latest when the roller slot below the respective roller is closed. In a particularly advantageous embodiment the hydraulic piston and cylinder system of the fixation device 6 is so constructed or controlled as to allow a raising displacement of the respective sliding member 3 but to prevent the lowering displacement of the latter. This signifies that the pressurized fluid can be sucked into the cylinder as a result of the displacement of the piston.

As a variant it can also be envisaged to develop the method in such a manner that the fixation device 6 is supplied with pressurized fluid during the raising or the lowering such that these devices 6 can also take a part of the weight forces.

A particularly important use of the method according to the invention is for instance the process of replacement of a roller. In this case the succession of steps to be effected is essentially as follows:

determination of the roller to be replaced when the calender is closed;

releasing of all fixation devices which are associated to the rollers disposed below the roller to be replaced;

lowering the roller to be replaced and all rollers which are disposed therebelow, in this case the respective supporting devices move until the lower abutment, the corresponding sliding members are lowered and simultaneously the shape of the fixation devices is modified;

after a predetermined lowering displacement of the roller stack the fixation device associated with the roller to be replaced is blocked;

the rollers disposed below the roller to be replaced are further lowered;

the roller to be replaced is freed and can be replaced;

once the replacement of the roller has been effected all fixing devices associated to the rollers disposed below the replaced roller are set in such a manner that a raising movement of the sliding members is possible;

the calender is slowly closed by raising the lower roller; in this case the support devices come into engagement against the upper abutment;

when the displaced rollers reach the vicinity of the desired position the respective fixing devices are blocked;

the rollers are brought in the desired position by further lowering of the lower roller without modifying the position of the sliding members.

In the event that the uppermost roller of the calender is not or only slightly movable in the pressing direction, a pressure supply of the fixation devices 6 associated with the rollers disposed therebelow can ensure, as long as the roller stack is still closed after the raising displacement, that the support device 8 is brought to a position for this purpose between the end abutments. The same purpose can also be achieved by the pressurization of the correspondingly designed support devices 8 themselves.

It can also be advantageous to adjust or to maintain the support devices 8 by a corresponding pressurization during the positioning in a position between their end abutments. It would be thereby possible to bring the roller to be adjusted in the desired position already during the raising displacement.

It is obvious that with the method according to the invention the position of several rollers of the calender can also be adjusted.

Figure 4:
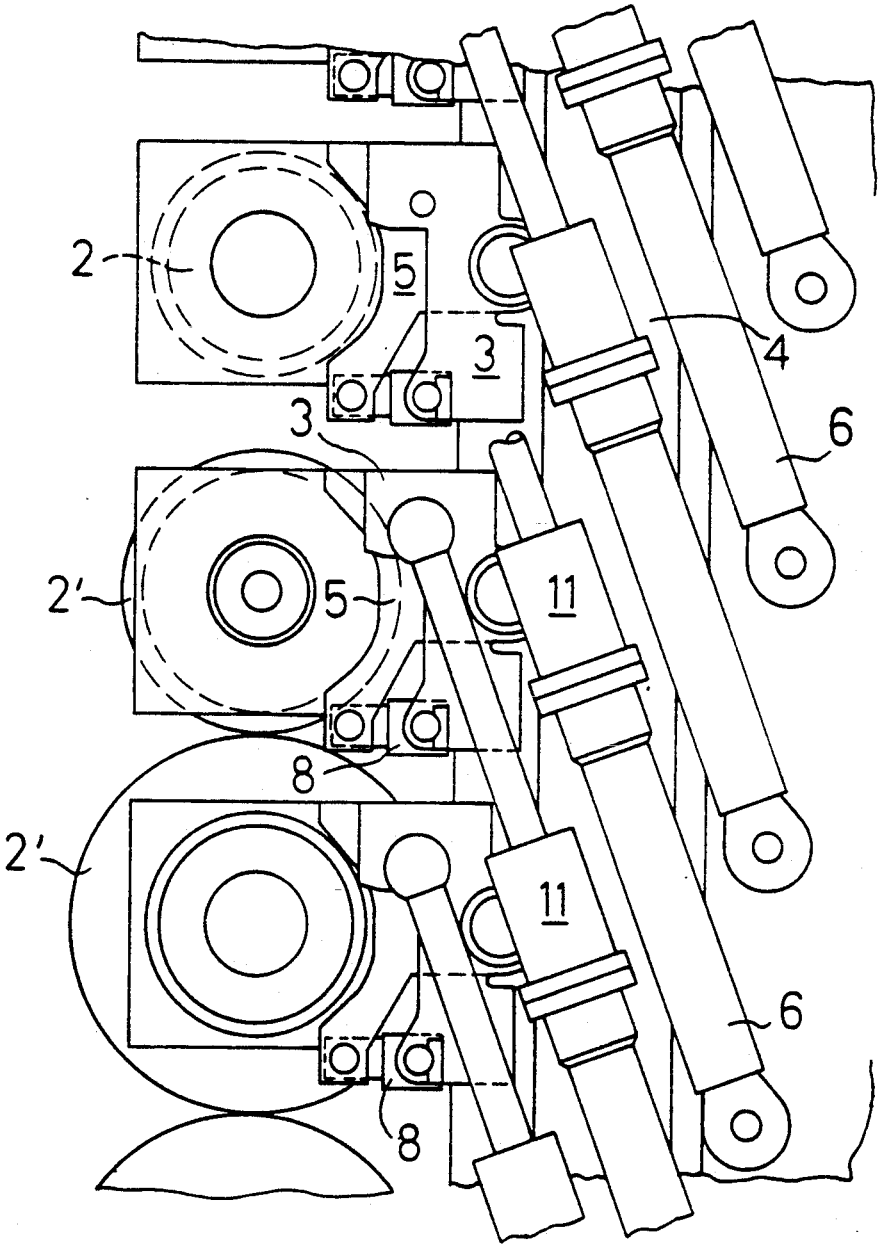
FIG. 4 is a detailed partial side view of the calender according to the invention.

FIG. 4 shows a portion of a calender structure according to the invention, having a freely accessible roller 2 as well as the superposed rollers 2', the blocking device 8 embodied in this case as a hydraulic positioning motor, the sliding member 3 and the lever 5 as well as the fixation devices 6. In the fixation devices 6 is integrated an additional blocking unit 11 which would remain autonomously in operation also in case of failure of the energy supply connected thereto. Blocking units of this type are known per se in other technical fields. They comprise for example a spring system which comprises a clamping seat for blocking the piston rod, the spring system being suitable for blocking the clamping seat. In the vicinity of the spring system can be introduced a pressurized fluid, which creates a pressure force, which in turn acts again the spring system whereby the blocking of the clamping seat can be released. Such systems are available on the market under the name of safety clamping unit.

It is immediately apparent that further structural parts not mentioned here can also be used in order to carry out the method. For example electrical positioning motors can be envisaged in lieu of the hydraulic positioning motors.

In a calender which is equipped for the normal operation with an adjustment system, the control for carrying out the method of the invention can also be integrated in this adjustment system. It is particularly advantageous in this case to perform the successive method steps in an automatic running program in the adjustment system.

We claim:

1. Calender comprising:

a support (4);

an uppermost roller;

a lowermost roller;

intermediate rollers disposed between said uppermost roller and said lowermost roller;

means (7) for achieving a raising or lowering displacement of said lowermost roller;

respective bearings for said intermediate rollers, said bearings being supported on sliding members (3) and said sliding members being vertically movable with respect to said support (4);

a plurality of levers (5), each of said levers having a first end and a second end, said first end pivotally connected to a respective one of said sliding members about a respective pivot axis and said second end connected to an associated end of one of said intermediate rollers; and fixation devices (6) for fixing said sliding members relative to said support, wherein each of said fixation devices (6) is formed as a respective piston and cylinder unit comprising a piston and a cylinder, said unit having a first end secured to said support (4) and a second end secured to the respective sliding member (3), wherein a pressurized fluid supply is provided for said piston and cylinder units, there being means for controlling the admission of pressurized fluid to and the discharge of pressurized fluid from said piston and cylinder units and for selectively blocking the displacement of the piston within the cylinder of said unit.

2. Calender according to claim 1, wherein said means (7) for achieving the raising or lowering displacement of said lowermost roller comprises a positioning motor which is also usable for an opening of said calender.

3. Calender according to claim 2, wherein said positioning motor comprises a hydraulically actuated positioning motor.

4. Calender according to claim 1, wherein said lowermost roller comprises a deflection compensation roller having adjustable supporting members and wherein said means (7) for achieving the raising or lowering displacement of said lowermost roller further comprises said adjustable supporting members of said deflection compensation roller.

5. Calender according to claim 1, wherein the calender further comprises a deflection compensating roller having adjustable supporting members and wherein said means (7) for achieving the raising or lowering displacement of said lowermost roller is formed by adjustable supporting members of said deflection compensating roller.

6. Calender according to claim 1, wherein a blocking unit (11) is provided on each of said hydraulic piston and cylinder units for generating a blocking force to selectively block the displacement of the hydraulic piston within said piston and cylinder units.

7. Calender according to claim 6, wherein each of said blocking units (11) comprises a clamping seat, a spring system biasing said clamping seat, and means for generating a pressure force from a pressurized fluid introduced to the respective blocking unit in the vicinity of said spring system in order to release said spring system to thereby cancel said blocking force.

8. Calender according to claim 7, wherein said blocking unit (11) comprises a clamping seat which blocks said fixation device (6), and wherein said blocking unit further comprises engagement means for releasing said clamping seat.

9. Calender according to claim 1, wherein each of said blocking units is operable in addition to the respective one of said piston and cylinder units.

10. Calender according to claim 9, wherein said blocking unit (11) is formed integrally with the piston and cylinder unit.

11. Calender according to claim 1, further comprising a plurality of supporting devices (8) wherein a respectively associated one of said supporting devices extends between said sliding member and said lever, and wherein said supporting devices (8) are constructed and disposed so as to maintain a constant desired angle between said lever (5) and said sliding member (3) during positioning of said rollers on said calender.

12. Calender according to claim 11 in which said supporting devices are formed as hydraulic force members each having an end stop for limiting the upward displacement of the respective lever (5).

13. Calender comprising:

a support;

an uppermost roller and a lowermost roller;

an intermediate roller between the uppermost roller and the lowermost roller;

a sliding member (3) pivotally connected about a pivot axis to a first end of a lever having first and second ends, said second end of said lever connected to an associated end of said intermediate roller, said sliding member being vertically movable with respect to said support (4) and having a fixation means (6) for coupling the sliding member to the support and being capable of fixing said sliding member to the support (4) to thereby determine a respective position of the intermediate roller, the intermediate roller having bearings supported on the sliding member (3), wherein the calender comprises a motor (7) for achieving the raising or lowering displacement of said lowermost roller, said motor (7) being hydraulically actuated to open the calender, said fixation means (6) having a blocking unit capable of generating a blocking force (11), the fixation means (6) being blocked by said blocking force.

14. Calender according to claim 13, wherein the blocking unit (11) is provided with a spring system biasing a clamping seat, said blocking unit including means for generating a pressure force from a pressurized fluid introduced to the respective blocking unit in the vicinity of the spring system to release the latter to thereby cancel the blocking force.

15. Calender according to claim 14, wherein said blocking unit (11) is provided with a clamping seat which automatically blocks the fixation means (6), said blocking unit including engagement means for releasing the clamping seat.

16. Calendar according to claim 3, wherein the blocking unit (11) is operable in addition to the motor (7).

17. Calendar according to claim 16, wherein the blocking unit (11) is integrated to the structure of the motor (7).

18. Calender comprising:

a support (4);

an uppermost roller;

a lowermost roller;

intermediate rollers disposed between said uppermost roller and said lowermost roller;

means (7) for achieving a raising or lowering displacement of said lowermost roller;

respective bearings for said intermediate rollers, said bearings being supported on sliding members (3) and said sliding members being vertically movable with respect to said support (4); and fixation devices (6) for fixing said sliding members relative to said support, wherein each of said fixation devices (6) is formed as a respective piston and cylinder unit comprising a piston and a cylinder, said unit having a first end secured to said support (4) and a second end secured to the respective sliding member (3), wherein a pressurized fluid supply is provided for said piston and cylinder units, there being means for controlling the admission of pressurized fluid to and the discharge of pressurized fluid from said piston and cylinder units, said units further including a respective blocking unit (11) for generating a blocking force to selectively block the displacement of said piston, said blocking unit comprising a clamping seat, a spring system biasing said clamping seat, and means for generating a pressure force from a pressurized fluid introduced to the respective blocking unit in the vicinity of said spring system to release said spring system and cancel said blocking force.

19. Calender according to claim 18, further comprising a plurality of levers (5) and a plurality of supporting devices, each of said levers having a first end and a second end, said first end being pivotally connected to a respective one of said sliding members about a respective pivot axis and said second end being connected to an associated end of one of said intermediate rollers, wherein a respectively associated one of said supporting devices extends between said sliding member and said lever, and wherein said supporting devices (8) are constructed and disposed so as to maintain a constant desired angle between said lever (5) and said sliding member (3) during positioning of said rollers on said calender, and to take up the nip relieving forces in operation of said calender.

20. Calender comprising:

a support;

an uppermost roller and a lowermost roller;

an intermediate roller between the uppermost roller and the lowermost roller;

a sliding member (3) connected to said intermediate roller and vertically movable with respect to said support (4), said sliding member (3) having a fixation means (6) for coupling the sliding member to the support, said fixation means being capable of fixing said sliding member to the support (4) to thereby determine a respective position of the intermediate roller, the intermediate roller having bearings supported on the sliding member (3), wherein the calender comprises a motor (7) for achieving the raising or lowering displacement of said lowermost roller, said motor (7) being hydraulically actuated to open the calender; and a blocking unit (11) connected to said fixation means, said blocking unit generating a blocking force to prevent movement of said fixation means, said blocking unit comprising a spring system biasing a clamping seat and including means for generating a pressure force from a pressurized fluid introduced to the blocking unit in a vicinity of the spring system to release said spring system to cancel said blocking force.

* * * * *